United States Patent [19]

Robaldo

[11] 4,361,968

[45] Dec. 7, 1982

[54] APPARATUS FOR POLYMERIZATION OF ADHESIVE RESIN APPLIED TO THE JUNCTIONS OF TENNIS RACKET NETTING

[76] Inventor: Aldo M. Robaldo, Corso Francia 33, Turin, Italy

[21] Appl. No.: 206,671

[22] Filed: Nov. 13, 1980

[30] Foreign Application Priority Data

Jan. 11, 1980 [IT] Italy ..... 52826/80[U]

[51] Int. Cl.[3] ..... F26B 9/06

[52] U.S. Cl. ..... 34/196; 34/197; 312/236; 165/DIG. 25; 118/58

[58] Field of Search ..... 34/195, 196, 197, 219; 312/236; 165/DIG. 25, DIG. 26; 118/58

[56] References Cited

U.S. PATENT DOCUMENTS 11,460 12/1894 Proctor ..... 34/196

3,362,081 1/1968 Bogenberger ..... 34/196

4,152,842 5/1979 Laughlin ..... 34/196

FOREIGN PATENT DOCUMENTS 1211553 2/1966 Fed. Rep. of Germany ..... 34/196

*Primary Examiner*—Larry I. Schwartz

*Attorney, Agent, or Firm*—Maky, Renner, Otto & Boisselle

[57] ABSTRACT

An apparatus for polymerization of adhesive resin applied to the junctions of tennis racket netting, comprising a container having a plurality of superimposed compartments communicating with one another and each arranged to receive a racket, a source of heat arranged below the compartments and a fan arranged above said compartments for circulation of heated air from said source of heat through said compartment and a vertical passage adjacent said compartments back to the bottom of said container.

11 Claims, 4 Drawing Figures

APPARATUS FOR POLYMERIZATION OF ADHESIVE RESIN APPLIED TO THE JUNCTIONS OF TENNIS RACKET NETTING

This invention relates to an apparatus for polymerization of adhesive resin applied to the junctions of tennis racket netting.

The application of adhesive resin such as an epoxide resin, particularly an epoxide resin comprising two components, to the junctions between the perpendicular strings of tennis racket netting improves the behaviour of tennis racket netting, in particular with regard to its resiliency as it is hit by a tennis ball. The application of epoxide resin to the junctions of tennis racket netting is a delicate operation which must be carried out with great accuracy to avoid irregularities in the arrangement of the junctions in the final netting. To facilitate the application of synthetic resin to the junctions of tennis racket netting a special syringe has been proposed in Applicant's copending Patent Application Ser. No. 204,586 filed Nov. 6, 1980.

However, the synthetic resin applied by such a syringe requires rather a long time for drying or polymerization which in still air and at ambient temperature takes about 15 to 20 hours. Also the quality of setting of the adhesive in the finally obtained junction of netting varies according to the temperature and relative humidity of the air in which the adhesive has been dried, particularly with regard to the toughness of the adhesive.

It is therefore an object of the present invention to provide an apparatus for efficient polymerization of adhesive resin applied to the junctions of tennis racket netting, particularly by a syringe as described in Applicant's aforementioned copending application, so that within a relatively short time a finished racket can be obtained in which the junctions of the netting have excellent toughness and all rackets thus produced have the same quality.

This object is achieved according to the present invention by providing an apparatus for polymerization of adhesive resin applied to the junctions of tennis racket netting, which comprises a parallelepipedic container having a plurality of superimposed compartments communicating with one another and each arranged to receive a racket, a source of heat arranged substantially below said compartments and a fan arranged substantially above said compartments for circulation of air from said source of heat through said compartments and a passage extending vertically through said container along one side thereof adjacent said superimposed compartments. A preferred embodiment of the invention will now be described by way of example and with reference to the accompanying drawing in which:

Figure 1:
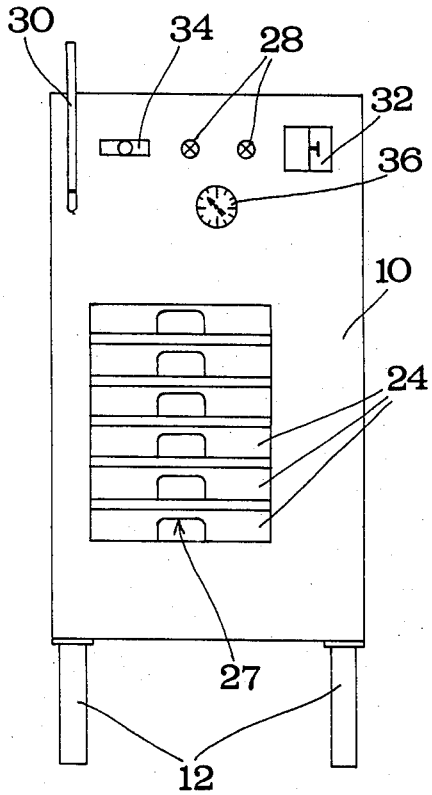
FIG. 1 is a front elevational view of an apparatus according to the invention.
Figure 2:
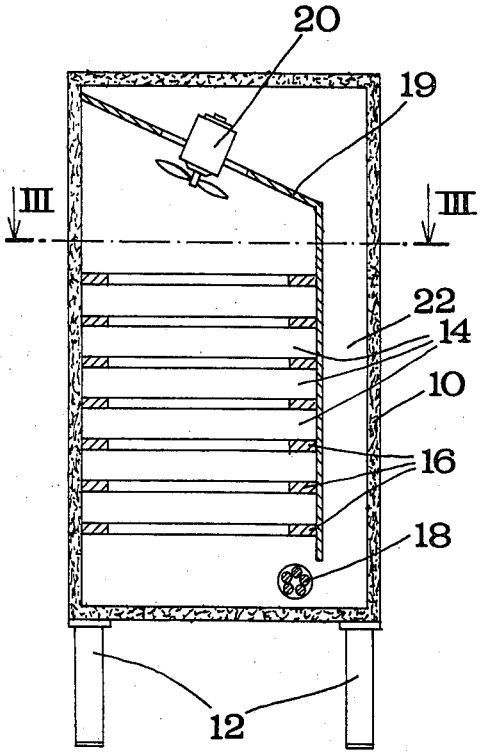
FIG. 2 is a vertical section through the apparatus of FIG. 1.
Figure 3:
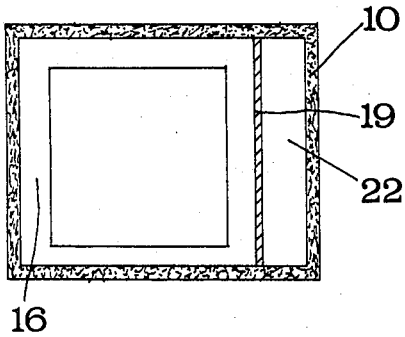
FIG. 3 is a horizontal section through the apparatus, taken on the line III—III of FIG. 2.

Referring to FIGS. 1 to 3, an apparatus for thermal treatment for the purpose of polymerization of adhesive resin applied to the junctions of tennis racket netting according to the invention comprises a housing 10 in the form of a parallelepiped with insulated side, bottom and top walls and supported by legs 12. A plurality of superimposed compartments 14 is arranged in the housing 10 and horizontally defined by open partitions 16 having large central openings to permit continuous communication between the various compartments.

A source of heat formed by an electric resistor 18 is arranged near the bottom of the housing 10. Arranged above the compartments 14 is an inclined partition 19 having a central opening in which an electric fan 20 is mounted for producing an upward flow of air through the compartments 14. The air flow thus produced then returns toward the bottom of the housing 10 and to the source of heat 18 through a lateral passage 22 extending vertically through the housing 10 along one side thereof adjacent the superimposed compartments 14.

Figure 4:
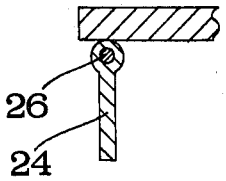
FIG. 4 is a section through a detail of the apparatus of FIGS. 1 to 3.

The compartments 14 have relatively high and wide rectangular front openings adapted to receive the oval head portion of a tennis racket to be inserted longitudinally into the compartment so as to leave only the handle outside. Preferably each compartment is forwardly closed by a front door 24 mounted for pivotal movement about a horizontal axis formed by a pivot 26 (FIG. 4) extending along its upper edge to permit pivotal movement of the door in both directions. Each door 24 has a central cut-out portion 27 through which the handle of a racket (not shown) is allowed to project from the compartment.

To facilitate use of the apparatus it is further provided with accessories such as warning lights 28, a thermometer 30, a thermostat 32, a main power make-and-break switch 34 and a control timer 36.

The source of heat 18 and the fan 20 are so dimensioned that the temperature in the compartments 14 will be between 25° and 32° C., preferably between 27° and 30° C., during operation of the apparatus. It has been found that with a temperature in this range and slow circulation of air along the racket netting an excellent setting of the adhesive can be obtained within about five hours.

The operation of the apparatus is as follows:

After the adhesive resin has been applied to the junctions of tennis racket netting one or more rackets (not shown) are introduced into the compartments 14 by pushing them simply against the doors 24 which will move inwardly to permit the racket to pass and then return to their vertical position to close the compartment relative to the ambient air so that only the handle of the racket will project outwardly through the cut-out portion 27.

Then the apparatus is switched on by actuation of the main switch 34. During the initial period of treatment the rackets are conveniently turned over several times to ensure uniform distribution of the adhesive over the junctions of netting and to compensate for the unbalancing effect of gravity. As is seen in FIGS. 1 and 2, the vertical dimension of respective compartments is less than the usual diameter of a racket head, and, therefore, the communication between compartments afforded by the relatively large central openings in the respective partitions 16 provide for at least part of the respective racket heads at least part of the clearance, i.e. down into the compartment below, to enable the respective rackets to be turned over as aforesaid. The timer 36 helps to ensure this operation to be carried out regularly by actuating an acoustic signal device emitting a sound which indicates to the operator when the rackets have to be turned over. Thus, the entire polymerization treatment is carried out at a temperature in the range from 27° to 30° C., the maintenance of this temperature being controlled by the thermostat 32. The entire duration of the treatment is about five hours. After this period the apparatus is de-energized by the timer 36.

Although a preferred embodiment of the invention has thus been described in detail and illustrated in the accompanying drawing it is to be understood that numerous changes and modifications obvious to one skilled in the art may be made therein without departing from the scope of the invention as defined by the appended claims.

I claim:

1. For use with tennis rackets an apparatus for polymerization of adhesive resin applied to the junctions of tennis racket netting, the improvement comprising a parallelepipedic container having a plurality of superimposed compartments communicating with one another and each arranged to receive at least a portion of a racket, a source of heat arranged substantially below said compartments, means for circulation of air from said source of heat through said compartments, a passage means extending vertically through said container along one side thereof adjacent said superimposed compartments for conducting air flow from said compartments to said source of heat, a thermostat for maintaining the temperature within said compartments at a desired constant level, and a control timer, and wherein each of said compartments has a front door mounted for pivotal movement about a horizontal axis on a pivot extending along its upper edge so that said door can pivot in both directions, said door being provided with a central cut-out portion to permit the handle of a racket to project therethrough.

2. An apparatus as claimed in claim 1, said compartments having clearance to permit rotating of such racket portion therein without removing the racket therefrom.

3. An apparatus as claimed in claim 2, such racket comprising an enlarged head and a handle extending therefrom, and wherein said compartments have clearance to permit rotation of such racket head.

4. For use with tennis rackets an apparatus for polymerization of adhesive resin applied to the junctions of tennis racket netting, the improvement comprising a parallelepipedic container having a plurality of superimposed compartments communicating with one another and each arranged to receive at least a portion of a racket, a source of heat arranged substantially below said compartments, means for circulation of air from said source of heat through said compartments, a passage means extending vertically through said container along one side thereof adjacent said superimposed compartments for conducting air flow from said compartments to said source of heat, a thermostat for maintaining the temperature within said compartments at a desired constant level, and a control timer, said compartments having clearance to permit rotating of such racket portion therein without removing the racket therefrom, such racket comprising an enlarged head and a handle extending therefrom, and each of said compartments has side walls and an opening means in at least one of said side walls for permitting such racket handle to project therethrough while such racket head remains in said compartment, whereby such racket handle may be manipulated to rotate such racket head without removing such head from said compartment.

5. An apparatus as claimed in claim 4, further comprising mounting means for mounting said at least one of said side walls for pivotal movement thereof to permit insertion and removal of such racket head with respect to such compartment.

6. An apparatus as claimed in claims 2 or 5, further comprising partition means for vertically separating adjacent compartments, each partition means having a relatively large central opening means therein for permitting continuous communication between such compartments.

7. An apparatus as claimed in claim 5, further comprising partition means for vertically separating adjacent compartments, each partition means having a relatively large central opening means therein for permitting continuous communication between said compartments, said partition means being mounted closer than the relatively larger cross-sectional diameter of such racket head and said relatively large central opening means providing at least a portion of such clearance to permit such rotation of such head without removing the latter from its compartment.

8. For use with tennis rackets an apparatus for polymerization of adhesive resin applied to the junctions of tennis racket netting, the improvement comprising a parallelepipedic container having a plurality of superimposed compartments communicating with one another and each arranged to receive at least a portion of a racket, a source of heat arranged substantially below said compartments, means for circulation of air from said source of heat through said compartments, a passage means extending vertically through said container along one side thereof adjacent said superimposed compartments for conducting air flow from said compartments to said source of heat, a thermostat for maintaining the temperature within said compartments at a desired constant level, and a control timer, said compartments having clearance to permit rotating of such racket portion therein without removing the racket therefrom, and further comprising partition means for vertically separating adjacent compartments, each partition means having a relatively large central opening means therein for permitting continuous communication between such compartments, said partition means being mounted closer than the relatively larger cross-sectional diameter of such racket head and said relatively large central opening means providing at least a portion of such clearance to permit such rotation of such head without removing the latter from its compartment.

9. An apparatus, as claimed in claim 1, 4 or 8, wherein said source of heat is formed by an electric resistor.

10. An apparatus, as claimed in claim 1, 4 or 8, wherein said means for circulation of air is a fan, and said source of heat and said fan are dimensioned to maintain a temperature in the range between 27° and 30° C. in said compartments.

11. An apparatus, as claimed in claim 1, 4 or 8, wherein said control timer comprises means for producing a signal when it is time during use of the apparatus to polymerize adhesive resin applied to the junctions of the tennis racket netting to turn over such tennis racket.

* * * * *